United States Patent [19]

Hutter, III et al.

[11] Patent Number: 5,064,098

[45] Date of Patent: Nov. 12, 1991

[54] DUAL COMPONENT DISPENSER GUN

[75] Inventors: Charles G. Hutter, III, Carson City; Raymond R. Hill, Stagecoach, both of Nev.

[73] Assignee: Physical Systems, Inc., Carson City, Nev.

[21] Appl. No.: 484,157

[22] Filed: Feb. 23, 1990

[51] Int. Cl.[5] ..... B67D 5/52

[52] U.S. Cl. ..... 222/137; 222/327; 222/389; 222/392

[58] Field of Search ..... 222/137, 145, 334, 276, 222/459, 326, 327, 392, 389

[56] References Cited

U.S. PATENT DOCUMENTS

| | | | |
|---|---|---|---|
| 1,857,084 | 5/1932 | Goetz . | |
| 2,093,387 | 9/1937 | Tear | 222/392 |
| 3,390,814 | 7/1968 | Creighton, Jr. et al. . | |
| 3,401,847 | 9/1968 | Downing . | |
| 3,404,869 | 10/1968 | Harder . | |
| 3,424,439 | 1/1969 | Baker . | |
| 3,583,678 | 6/1971 | Harder . | |
| 3,627,275 | 12/1971 | Gusmer . | |
| 3,767,085 | 10/1973 | Cannon et al. . | |
| 3,799,396 | 3/1974 | Ashmead et al. . | |
| 3,942,563 | 3/1976 | Connors et al. . | |
| 3,989,228 | 11/1976 | Morris et al. . | |
| 4,062,472 | 12/1977 | Taube . | |
| 4,067,479 | 1/1978 | Moline | 222/137 X |
| 4,073,664 | 2/1978 | Zwirlein . | |
| 4,115,066 | 9/1978 | Muhle . | |
| 4,119,110 | 10/1978 | Stone . | |
| 4,168,018 | 9/1979 | Zahaykevich . | |
| 4,204,977 | 6/1980 | Zwirlein . | |
| 4,269,237 | 5/1981 | Berger . | |
| 4,302,481 | 11/1981 | Ribnitz et al. . | |
| 4,407,431 | 10/1983 | Hutter, III . | |
| 4,676,410 | 6/1987 | von Flue | 222/137 X |
| 4,869,400 | 9/1989 | Jacobs | 222/137 |
| 4,871,088 | 10/1989 | Cox | 222/137 X |
| 4,911,328 | 3/1990 | Keller | 222/334 X |

FOREIGN PATENT DOCUMENTS

| | | | |
|---|---|---|---|
| 3513880 | 10/1986 | Fed. Rep. of Germany | 222/392 |

*Primary Examiner*—Michael S. Huppert
*Assistant Examiner*—Gregory L. Husen
*Attorney, Agent, or Firm*—Kelly Bauersfeld & Lowry

[57] ABSTRACT

A dual component dispenser gun is provided for controlled dispensing of flowable dual component materials, such as adhesives, sealants and the like. The dispenser gun is designed for use with a dual component cartridge having dual barrles respectively filled with the two flowable components, in combination with a mixing nozzle through which the components can be mixed and dispensed. The cartridge is supported on top of a main pressure cylinder adapted for controlled connection to a pressurized fluid source, such as compressed air, for displacing a power piston in a first direction. The power piston is connected to a pair of flexible piston rods which extend through curved guide channels in a guide head and are connected in turn to a pair of piston plungers receivable into the cartridge barrels to dispense the dual components. A pressure responsive retractor assembly is carried by the power piston and responds to disconnection of the fluid source from the main cylinder to retract the power piston and associated piston plungers at least slightly and thereby eliminate drool of the flowable components from the mixing nozzle.

20 Claims, 4 Drawing Sheets

FIG. 1
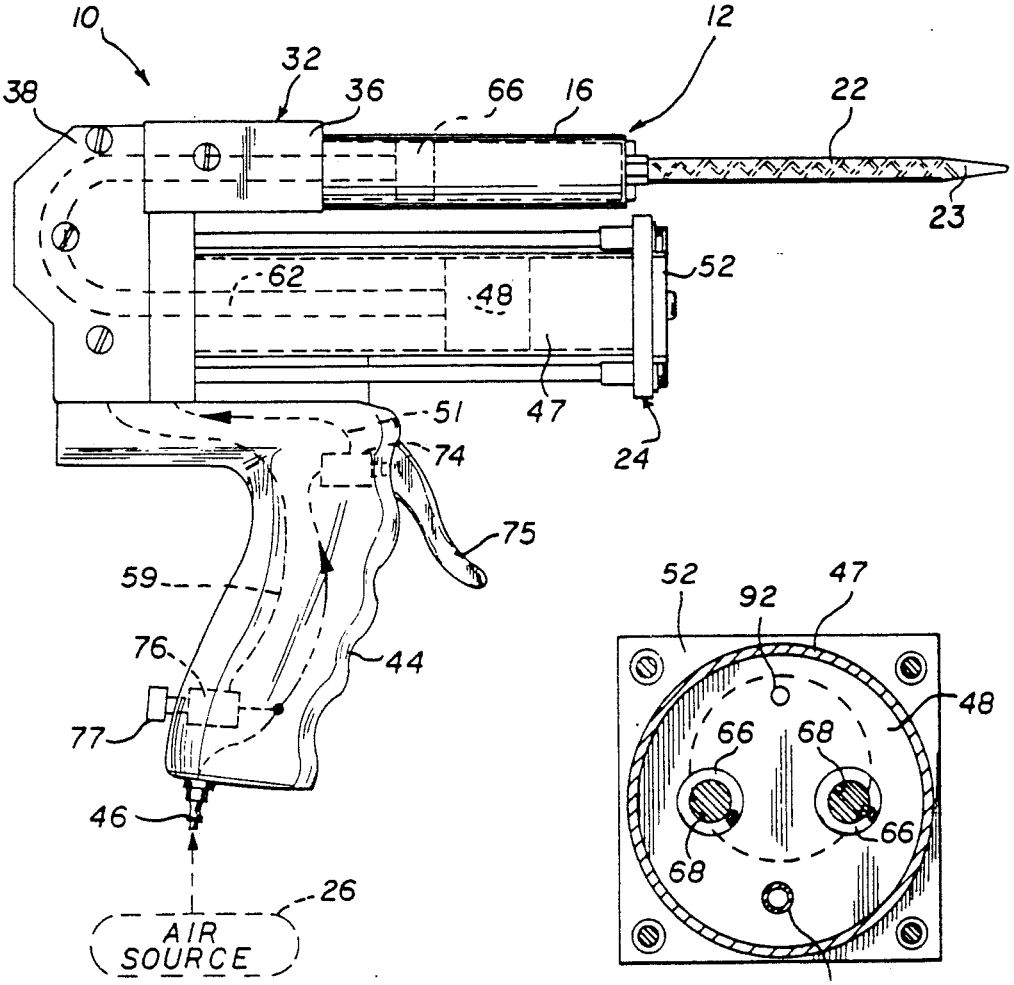
FIG. 8
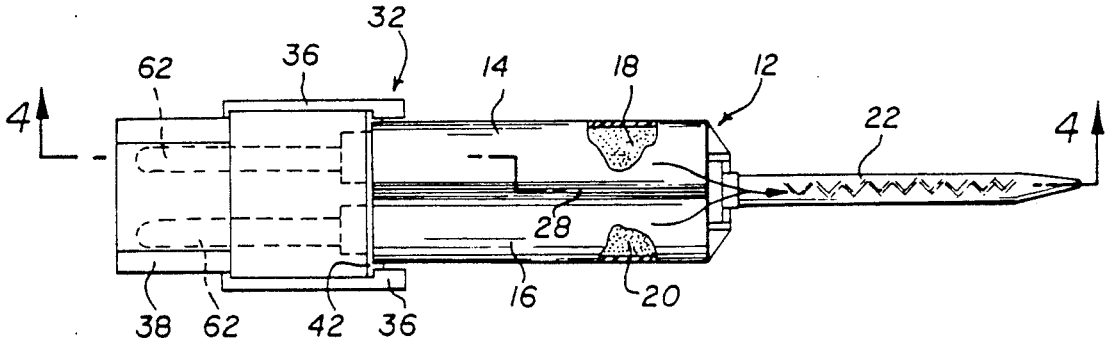
FIG. 2

DUAL COMPONENT DISPENSER GUN

BACKGROUND OF THE INVENTION

This invention relates generally to devices and systems for mixing and dispensing multicomponent curable compositions, such as adhesives or sealants of the type formed by mixture of dual flowable components mixed together in a prescribed ratio. More particularly, this invention relates to an improved dispenser gun for use in controlled mixing and dispensing of such multicomponent materials, wherein the dispenser gun has a significantly improved and highly compact geometry for facilitated manual handling during dispensing procedures, and further wherein the dispenser gun is equipped with means for preventing undesired drool or dripping of the mixed components when dispensing is interrupted.

Dispensing devices are relatively well known in the art for use in mixing and dispensing flowable dual component materials such as adhesives and sealants and the like. Such devices typically include means for pumping separate flowable components such as polymerizable base and accelerator materials in a prescribed ratio through an internally vaned mixing nozzle. The mixing nozzle is designed to intermix the components in a thorough manner as the components flow to and are dispensed from a nozzle tip. The mixed components are normally selected to set up or harden to a nonflowable state in a relatively short period of time after dispensing, referred to frequently as the "cure" time. Examples of such dual component compositions include polymerizable resins and the like which react chemically when mixed, such as a polysulfide resin material adapted to be mixed with a polymerization initiator such as an appropriate oxidizer. Alternately, mixed dual components may be used wherein hardening of the components is controlled and/or speeded upon exposure to elevated temperature. The specific type of flowable components and their mixing ratio can be varied widely such that the mixed composition will cure with a desired set of physical properties.

Curable compositions of this general type are widely used in many different industrial applications wherein the mixed components are applied through the nozzle tip directly to the desired surface or point of application on an industrial product. In this regard, in a typical assembly line environment, the nozzle tip must be manipulated by a worker to apply the mixed composition in an intermittent manner to a succession of production items, with the dispensing device including means for interruption of composition flow as the nozzle is moved from one production item to another.

In the past, a variety of dispensing systems and related dispensing devices have been proposed for use in mixing and dispensing dual component compositions. For example, as described in U.S. Pat. Nos. 3,767,085 and 3,989,228, relatively lightweight dispenser guns have been developed for mixing and dispensing dual components contained within a convenient dual barrel cartridge which can be discarded when empty. Such dispenser guns have typically included manually operated ratchet mechanisms and the like for applying pressure to one or more pistons acting endwise upon the cartridge barrels to force the cartridge contents through a common mixing nozzle. Alternative designs have utilized power drive mechanisms such as a pneumatic piston unit for power dispensing of the mixed composition. In either case, the dispenser gun has exhibited a substantial length due to the endwise mounting of the cartridge and dispensing mechanisms. As a result, such dispenser guns have been cumbersome, and/or have required significant manual effort for operation. Moreover, such dispensing guns have demonstrated an extremely annoying tendency to drool or dribble a small amount of the mixed composition when the dispensing pressure applied to the cartridge has been relieved with the intent of halting composition flow.

There exists, therefore, a significant need for further improvements in dispenser guns of the type designed for dispensing mixed components of a curable composition or the like, particularly wherein the improved device is compact, lightweight, and relatively well balanced for easy manual handling while providing power driven dispensing, and further wherein undesired drool of the mixed composition is substantially prevented between successive dispensing steps. The present invention fulfills these needs and provides further related advantages.

SUMMARY OF THE INVENTION

In accordance with the invention, an improved dispenser gun is provided for use in dispensing mixed flowable components of a multicomponent composition, such as an adhesive or sealant or the like. The dispenser gun is designed for use with a dual component cartridge of the type having twin barrels separately containing a pair of flowable components, in combination with a mixing nozzle through which the two components are mixed for dispensing. The dispenser gun includes a power piston unit having a pair of piston plungers receivable into the cartridge barrels to force the components through the mixing nozzle during a dispensing step. A retractor assembly within the power piston unit responds automatically to interruption of the dispensing step to retract the piston plungers at least slightly to positively relieve pressure applied to the cartridge and thereby prevent composition drool from the mixing nozzle.

In the preferred form, the power piston unit comprises a main pressure cylinder having a power piston mounted for reciprocation therein. This main cylinder is mounted upon a pistol-type handgrip adapted for connection to a pressurized fluid source, such as compressed air, and including a main control valve for selectively coupling the fluid source to the main cylinder to displace the power piston therein in a first direction. The power piston is connected by a pair of flexible piston rods to the pair of piston plungers These flexible piston rods extend through a pair of guide channels formed in a guide head, wherein these channels turn the piston rods back upon themselves such that power piston advancement in the first direction displaces the piston plungers together in a second, preferably opposite and parallel direction. The guide head further includes a fixture for receiving and supporting the cartridge with the piston plungers extending into the cartridge barrels. With this geometry, the dispenser gun has a short and compact overall length which can be substantially balanced over the handgrip for easy manual handling. Operation of the main control valve couples the fluid source to one end of the main cylinder to displace the power piston in a direction correspondingly displacing the piston plungers to dispense the components through the cartridge mixing nozzle. During such dispensing step, the opposite end of the main cylinder is connected through an exhaust valve to atmosphere The main control and exhaust valves are further adapted to connect the ends of the main cylinder to the fluid source and to atmosphere in a reverse manner to displace the power piston in a second direction retracting the piston plungers from the cartridge, for example, when the cartridge is empty.

The power piston has a hollow open-ended construction to permit the retractor assembly to be mounted therein. The retractor assembly includes a piston sleeve and associated check valve which cooperate with the power piston to define a pressure chamber within the power piston, wherein this pressure chamber is pressurized by the fluid source during a dispensing step. When the dispensing step is halted by relieving the fluid source at the pressure side of the power piston, a resultant pressure differential at one end of the piston sleeve causes the piston sleeve to displace through a short stroke with a snap action within the power piston to impact a stop on the power piston. This impact effectively retracts the power piston through a short increment, wherein this incremental retraction is applied via the piston rods to the piston plungers for corresponding slight plunger retraction. This plunger retraction is sufficient to relieve residual pressure on the cartridge attributable to cartridge hoop stress and the like to eliminate composition drool from the mixing nozzle. A bleed port associated with the piston sleeve pressure chamber relieves the accumulated pressure when this snap action occurs. However, the pressure chamber is re-charged through the check valve upon resumed dispensing.

Other features and advantages of the invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 1 is a side elevation view of an improved dual component dispenser embodying the novel features of the invention;

FIG. 2 is a top plan view of the dispenser gun;

FIG. 8 is a transverse vertical sectional view taken generally on the line 8–8 of FIG. 6.

DETAILED DESCRIPTION OF THE PREFERRED EMBODIMENT

Figure 3:
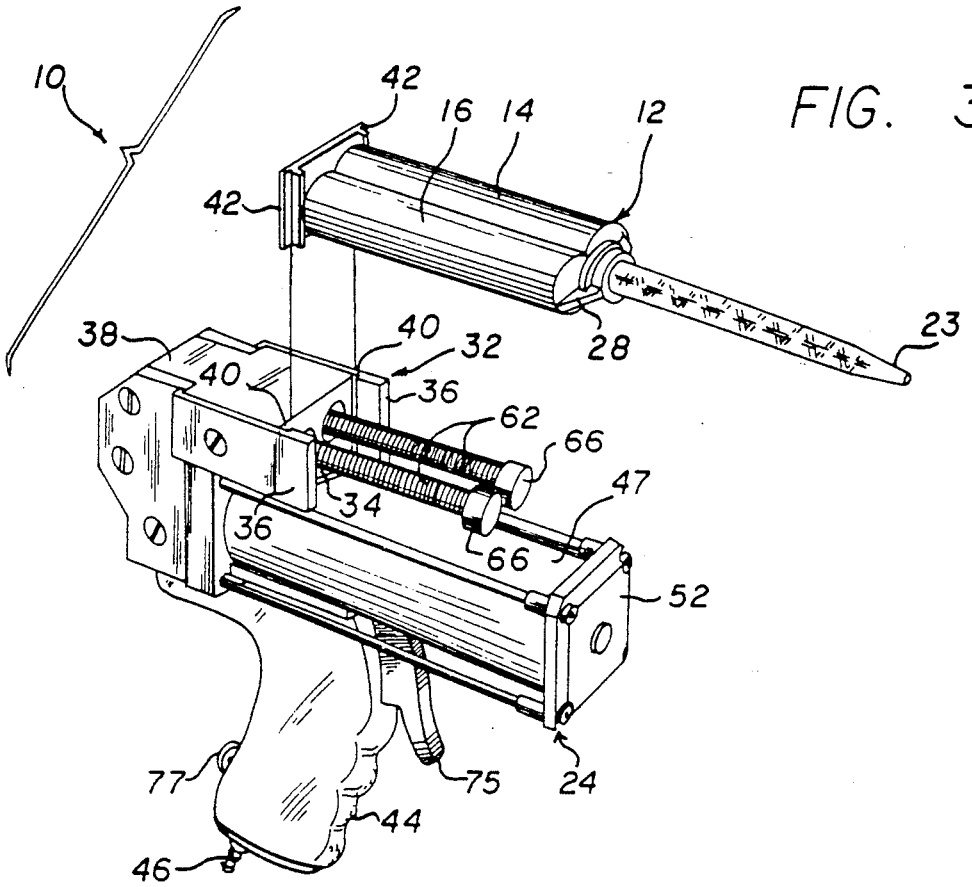
FIG. 3 is a perspective view of the dispenser gun depicted in exploded relation with a dual component cartridge.
Figure 9:
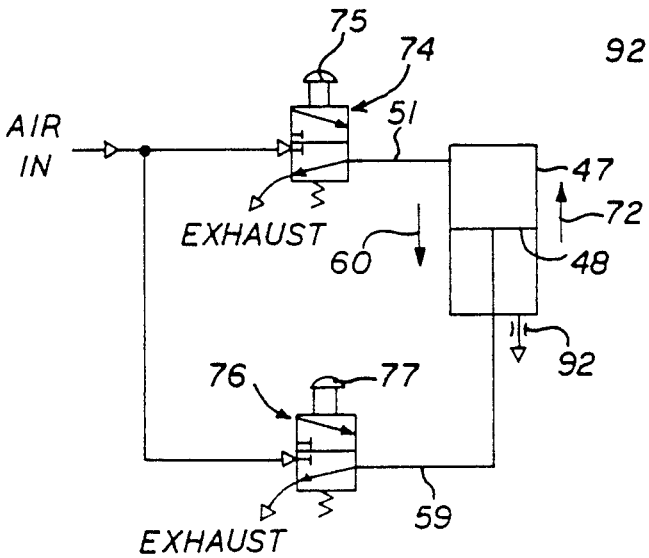
FIG. 9 is a schematic diagram depicting preferred pneumatic control components for use with the invention.

As shown in the exemplary drawings, an improved dispenser gun referred to generally by the reference numeral 10 in FIG. 1 is provided for use in mixing and dispensing multicomponent flowable materials, such as dual flowable components used to form adhesives and sealants and the like. The dispenser gun 10, in the preferred form, is designed for convenient use with a disposable cartridge 12 having separate barrels 14 and 16 for separately containing a selected pair of flowable components 18 and 20, in combination with a common mixing nozzle 22 through which the components 18 and 20 are mixed and dispensed. The cartridge is removably supported over a power piston unit 24 to provide a highly compact geometry which can be relatively well balanced for overall ease of use. Moreover, the power piston unit 24 includes means for substantially preventing drool or dripping of the mixed composition from the nozzle 22 whenever interruption of composition flow is desired.

The improved dispenser gun 10 of the present invention is particularly designed for use in a typical industrial environment wherein a controlled quantity of the mixed composition is dispensed for application to a succession of production items. In this regard, the dispenser gun 10 includes valve or switch means for appropriately connecting and disconnecting the power piston unit 24 with respect to a source of pressurized fluid, such as a source 26 of compressed air as depicted in FIG. 1. The fluid source 26 provides the drive medium for power dispensing of the cartridge contents through the mixing nozzle 22, exiting via a narrow nozzle tip 23. In accordance with one primary aspect of the invention, the power piston unit 24 responds automatically to disconnection from the fluid source 26, representative of desired cessation of composition flow from the nozzle 22, to substantially relieve residual pressure on the cartridge 12, wherein such residual pressure is commonly attributable to hoop stress stored within the cartridge during the preceding dispense step. By relieving this residual pressure, the dispenser gun 10 achieves a rapid and positive shut-off of composition flow, substantially without annoying drool of mixed composition from the nozzle tip 23.

The twin barrel cartridge 12 shown in FIGS. 1–4 is generally known in the art and is available for use with prior art dispensing equipment of a type described, for example, in U.S. Pat. Nos. 3,767,085 and 3,989,228. The cartridge 12 is typically constructed from a lightweight molded plastic to define the twin barrels 14 and 16 of generally cylindrical shape and interconnected by a web 28 to extend side-by-side in parallel relation. These barrels 14 and 16 are respectively filled or charged with the two flowable components 18 and 20 to be mixed and dispensed. Piston blocks 30 (FIG. 4) are provided to close the rear or breach ends of the barrels, and the forward ends are coupled in flow communication with the mixing nozzle 22. This mixing nozzle 22 is desirably internally vaned as described, for example, in U.S. Pat. Nos. 3,767,085 and 3,989,228 to insure thorough component mixing upon flow to the nozzle tip 23.

The dispenser gun 10 includes an upper support fixture 32 for removably receiving and supporting the cartridge 12. More particularly, as shown best in FIGS. 2 and 3, this support fixture 32 is defined by a support platform 34 extending laterally between a pair of lock arms 36 at a front end of a guide head 38 to be described in more detail. The lock arms 36 include vertical notches 40 on their inboard faces for slide-fit reception of laterally outwardly extending wings 42 (FIG. 3) at the rear end of the cartridge 12. Accordingly, the cartridge 12 can be installed quickly and easily onto the dispenser gun 10 by sliding the wings 42 downwardly within the notches 40 to seat upon the platform 34. In this position, the rear end of the cartridge barrels are seated directly in front of the guide head 38 for component dispensing, as will be described. When the cartridge barrels are empty, the cartridge 12 can be removed quickly and easily from the gun by simple lifting therefrom for easy disposal and replacement with a fresh cartridge.

In accordance with one primary aspect of the invention, the support fixture 32 orients the cartridge 12 directly over the power piston unit 24. The power piston unit 24 is mounted in turn over a convenient pistol-type handgrip 44 having a lower end adapted for connection to the pressure source 26 via an air hose fitting 46 or the like, and further including appropriate control valves for operating the power piston unit 24. The guide head 38 is positioned at a rear end of the power piston unit 24 and cooperates therewith to transmit a power drive action from the power piston unit 24 to the overlying cartridge. With this geometry, the combination dispenser gun and cartridge have a highly compact and short configuration which can be suitably positioned with significant balance over the pistol handgrip 44 for convenient manipulation and use with minimal operator fatigue.

Figure 4:
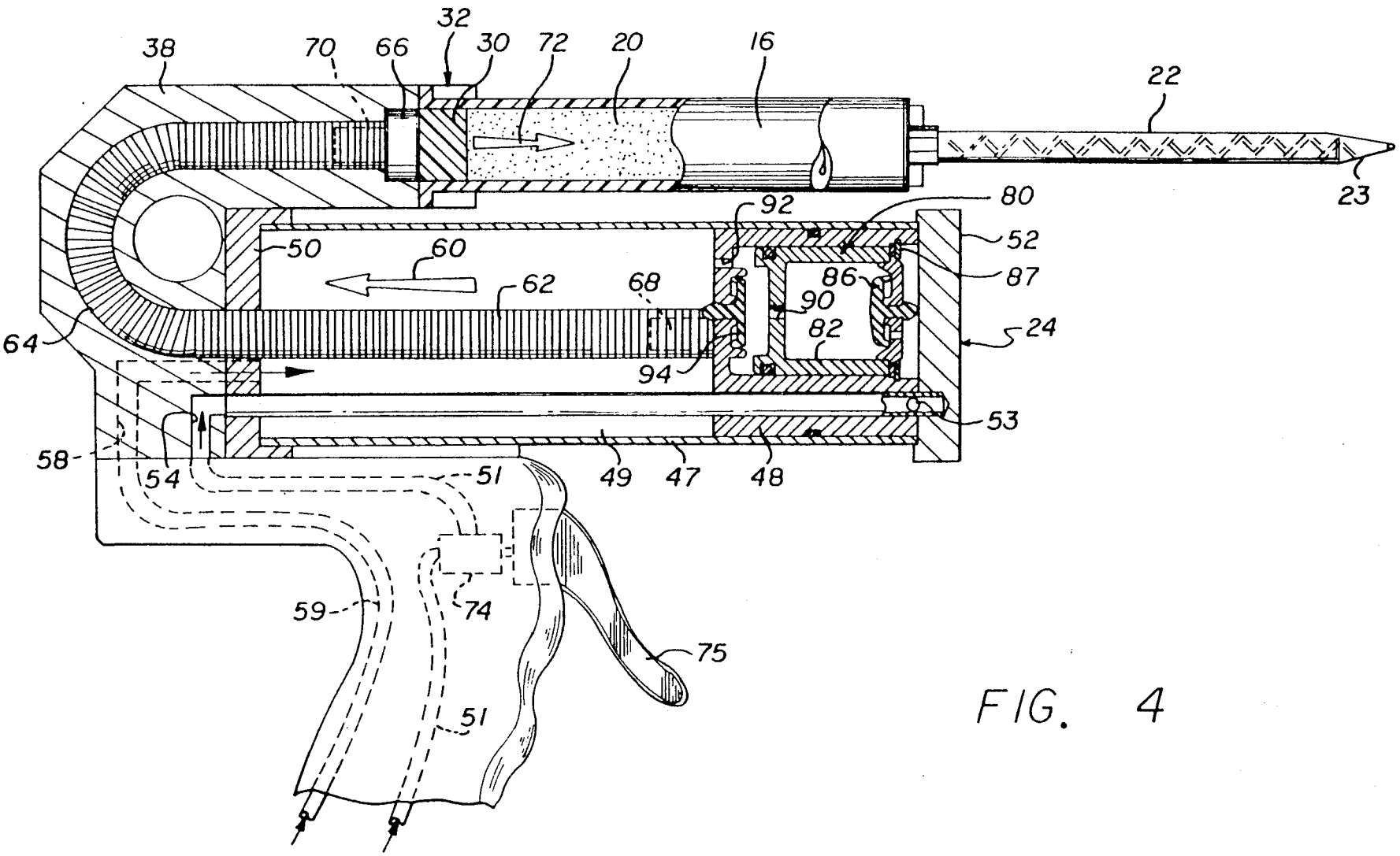
FIG. 4 is an enlarged longitudinal vertical section taken generally on the line 4–4 of FIG. 2.

As shown in FIG. 4, the power piston unit 24 comprises a main pressure cylinder 47 suitably mounted on top of the handgrip 44 to extend generally in a fore-aft direction. The main cylinder 47 has a power piston 48 mounted therein for movement in the fore-aft direction. During normal dispensing operation of the gun 10, the pressure source 26 is coupled via a guide tube 49 having its opposite ends seated respectively within a pair of end plates 50 and 52 which close the opposite ends of the cylinder. More particularly, the source 26 is coupled through a primary tube 51 in the handgrip 44 and a pressure port 54 in the guide head 38 for passage through the guide tube 49 substantially to the forward-most end of the cylinder. The guide tube 49 passes through the power piston 48 and has an exit port 53 formed therein generally at the front of the cylinder 47, such that fluid pressure is supplied into the cylinder 47 between the piston 48 and the front end wall 52. At the same time, the rear end of the cylinder 47 is exhausted to atmosphere through a bleed port 58 in the guide head and an exhaust tube 59 within the handgrip 44, such that the pressure source displaces the power piston 48 in a rearward direction, as depicted by the arrow 60 in FIG. 4.

The translational movement of the power piston 48 is mechanically coupled to the cartridge 12 by a pair of flexible piston rods 62. As shown in FIGS. 3 and 4, these piston rods 62 extend from a rear face of the power piston 48 through curved guide channels 64 in the guide head 38 for connection to a respective pair of piston plungers 66 at the rear end of the cartridge 12. While the construction of the flexible piston rods may vary, a preferred form as shown in the accompanying drawings comprises tightly coiled springs having opposite ends securely fitted over stub shafts 68 on the power piston 48, and similar stub shafts 70 on the piston plungers 66. Accordingly, movement of the power piston 48 in the aft direction as depicted by the arrow 60 (FIG. 4) displaces the piston rods 62 in a direction to advance the piston plungers 66 in an opposite or forward direction as depicted by the arrow 72. Such movement of the piston plungers 66 forces the two flowable components 18 and 20 through the mixing nozzle 22 for dispensing. During this motion, the connection of the two piston rods 62 to the power piston 48 cooperate with the guide tube 49 to guide the power piston without rotation within the main cylinder 47 (FIG. 8).

The handgrip 44 includes a trigger operated main control valve 74 together with an exhaust valve 76 to control operation of the power piston 48. More specifically, as shown in FIGS. 1, 3, 4 and 9, the main control valve 74 and the exhaust valve 76 comprise a pair of three-way pneumatic valve units which are biased by springs (FIG. 9) toward normal positions respectively connecting the pressure port 54 and the bleed port 58 to atmosphere. The main control valve 74 is provided with an exposed trigger lever 75 switch at the front of the handgrip 44 for depression first to an intermediate position disconnecting the pressure port 54 from atmosphere, and then to a pressure position for coupling the pressure port to the fluid source 26. In the pressure position, with the exhaust valve 76 coupling the bleed port 58 to atmosphere, the fluid source 26 displaces the power piston 48 to dispense the mixed composition, as previously described. This dispensing can take place at a maximum dispense rate by holding the main control valve 74 in the pressure position, or at a selected slower rate by displacing the trigger lever 75 back and forth between the intermediate and pressure positions. When interruption of composition dispensing is desired, the main control valve 74 can be released to vent the forward side of the power piston to atmosphere. Similarly, when the cartridge is empty or it is otherwise desired to remove the cartridge from the gun 10, the main control valve 74 is released to vent the forward side of the power piston to atmosphere, whereupon the exhaust valve 76 is switched by means of a pushbutton 77 or the like to reconnect the pressure source to the cylinder 47 at the rear side of the power piston 48. This alternate connection of the pressure source 26 to the cylinder displaces the power piston in an opposite direction to correspondingly retract the piston plungers 66 from the cartridge. In this regard, the pushbutton 77 for the exhaust valve 76 is desirably positioned for easy access but at a normally out-of-the-way position, such as at the lower rear side of the handgrip 44 as shown in FIGS. 1 and 3.

A retractor assembly 80 is included within the power piston unit 24 for preventing unwanted drool of mixed composition from the nozzle tip 23 when the main control valve 74 is released to depressurize the main cylinder 47. That is, residual pressure in the system attributable to hoop stress and the like within the cartridge 12 normally causes a small amount of composition to ooze from the nozzle tip even though flow interruption is desired. The retractor assembly 80 responds automatically to depressurization of the cylinder 47 to slightly retract the power piston 48, and thereby slightly retract the piston plungers 66 sufficiently to achieve substantially immediate relief of residual pressure in the cartridge.

Figure 5:
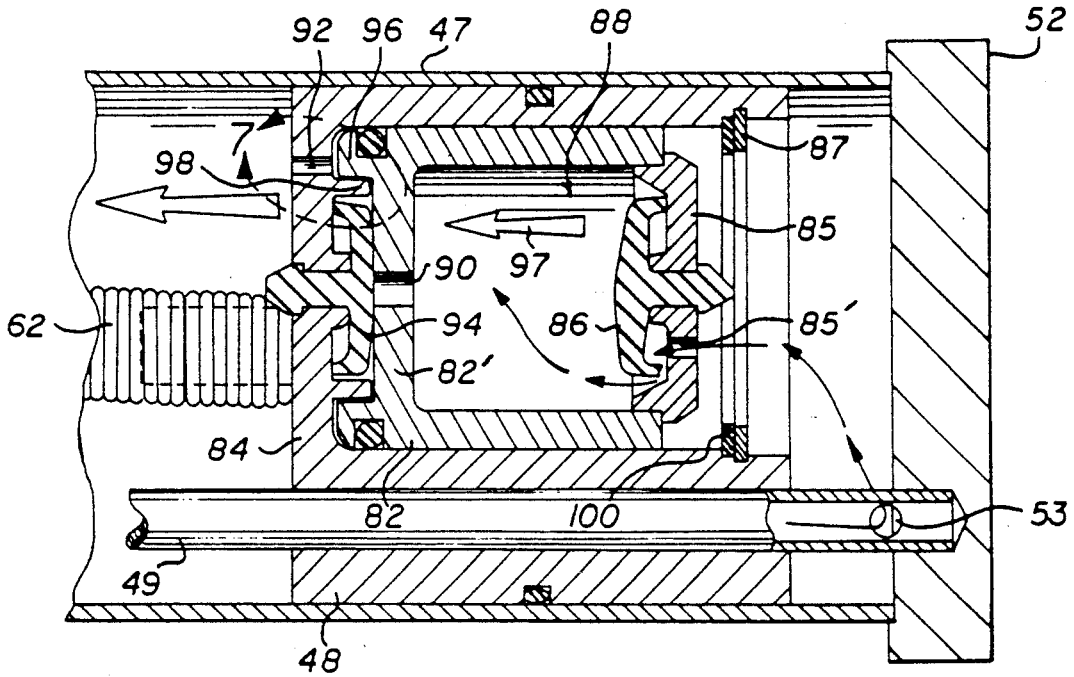
FIG. 5 is an enlarged fragmented vertical sectional view showing construction details of a power piston and associated retractor assembly.
Figure 6:
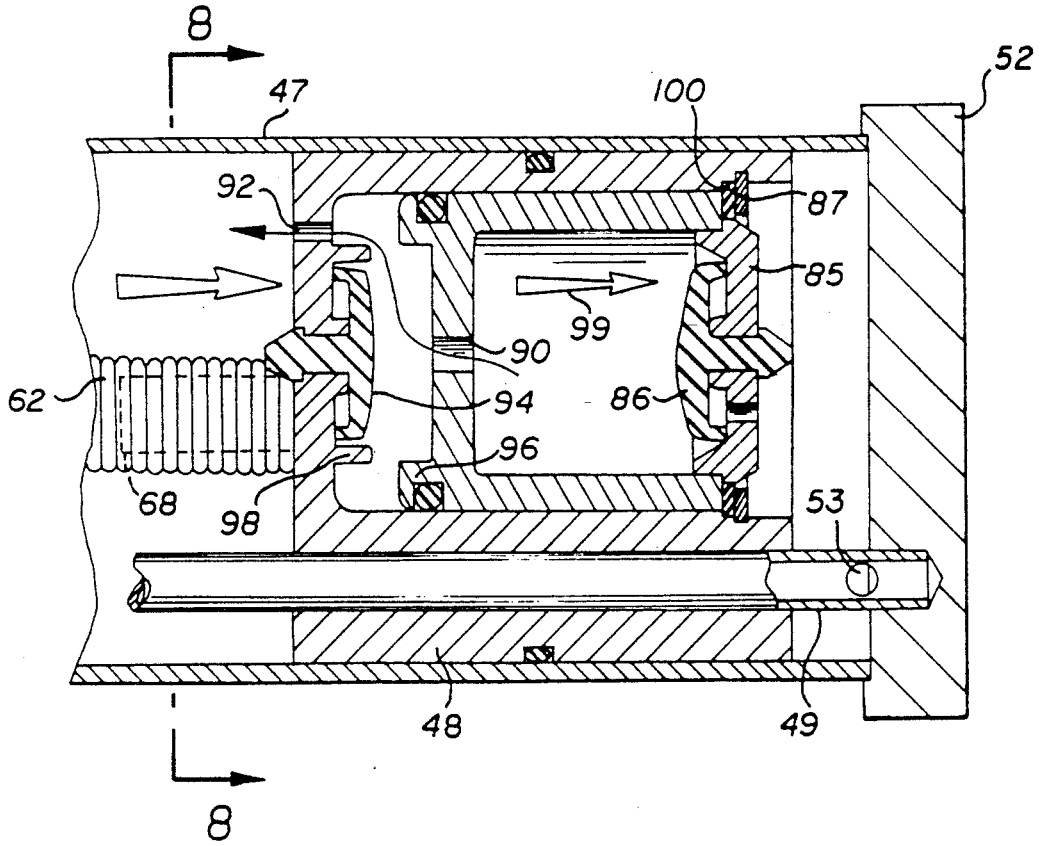
FIG. 6 is a vertical sectional view similar to FIG. 5, but depicting the retractor assembly in a alternative state of operation.

The retractor assembly 80 comprises a pressure responsive piston sleeve 82 mounted for reciprocation through a short stroke within the hollow interior of the power piston 48, as viewed in FIGS. 4–6. More particularly, the power piston 48 has a generally cup-shaped configuration defining an open forward end and a substantially closed rear face 84. The piston sleeve 82 has a similar cup-shaped configuration sized to fit into the interior of the power piston with a substantially closed rear face 82'. An end plate 85 is mounted on the forward end of the piston sleeve 82, and a stop ring 87 is seated within an appropriate ring groove near the forward end of the power piston to provide a forward limit to piston sleeve displacement.

During dispensing of the composition, the pressure source 26 is coupled to the forward side of the power piston 48, as previously described. This positive fluid pressure is communicated further through a port 85' in the end plate 85 and a one-way check valve 86 into a pressure chamber 88 within the piston sleeve 82. The pressure build-up within the chamber 88 is sufficient to override fluid escape through bleed ports 90 and 92 and formed respectively in the rear faces 82' and 84 of the piston sleeve 82 and power piston 48. Accordingly, the piston sleeve 82 is displaced within the power piston in the direction of arrow 97 to the position shown in FIG. 5, with the rear face 82' seated upon a resilient port seal 94 which blocks further fluid escape through the port 90. The pressure within the chamber 88 thus builds substantially to the delivery pressure of the fluid source 26.

Figure 7:
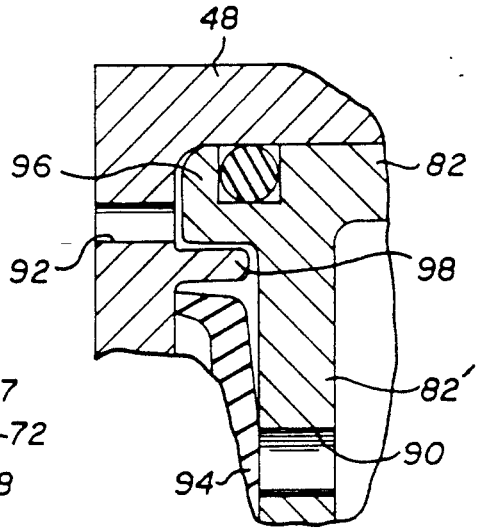
FIG. 7 is an enlarged fragmented sectional view corresponding generally with the encircled region 7 of FIG. 5.

When the main control valve 74 is released to vent the forward side of the power piston to atmosphere, the pressure level at the forward side of the power piston drops rapidly. When this occurs, the force acting upon the inboard side of the end plate 85 slightly exceeds the corresponding force acting upon the rear face 82', due to the presence of the bleed port 90 in the rear face 82', such that the piston sleeve 82 begins to shift within the power piston in a direction away from the port seal 94. This movement opens the bleed port 90 to permit fluid escape from the chamber 88 to the space between the rear faces 82'and 84 of the piston sleeve and power piston. Importantly, however, overlapping annular flanges 96 and 98 (FIGS. 5–7) on these rear faces provide an effective orifice which prevents full opening of the bleed port 92 and thereby applies the fluid pressure to a substantial portion of the piston sleeve face 82'. This application of fluid pressure to the rear face 82'of the piston sleeve 82 causes the piston sleeve to translate rapidly with a snap action in the direction of arrow 99 as shown in FIG. 6. This snap action motion impacts the forward edge of the piston sleeve 82 with the stop ring 87 to retract the power piston through a slight stroke, typically a few hundredths of an inch, sufficient to relieve residual pressure within the cartridge. A resilient wear ring 100 may be interposed between the piston sleeve and the stop ring 87 to soften this impact, if required. Upon resumed dispensing, the piston sleeve 82 shifts in the opposite direction against the port seal 94 and the chamber 88 is re-pressurized, as described above.

Accordingly, the improved dispenser gun 10 of the present invention provides a compact and easily balanced configuration for use in power dispensing of flowable multicomponent compositions and the like. Moreover, the gun includes automated means for relieving residual pressure when it is desired to interrupt dispensing, such that composition drool is avoided.

A variety of modifications and improvements to the invention will be apparent to those skilled in the art. Accordingly, no limitation on the invention is intended by way of the foregoing description and the accompanying drawings, except as set forth in the appended claims.

What is claimed is:

1. A dispenser gun for dispensing a flowable component composition from a cartridge having at least one barrel charged with a flowable component and a nozzle for passage of the flowable component from the barrel for dispensing, said dispensing gun comprising:

a power piston unit including a main pressure cylinder and a power piston reciprocal within said cylinder along a first direction;

head means defining a fixture adapted to receive and support the cartridge with the cartridge barrel oriented to extend generally along a second direction;

means for displacing said power piston within said main pressure cylinder;

a piston plunger adapted for reception into the cartridge barrel to dispense the flowable component through the nozzle; and a flexible coiled spring piston rod coupled at one end to said power piston and at an opposite end to said piston plunger, said piston rod extending from said power piston through a curved guide passage formed in said head means to said piston plunger, such that advancing displacement of said power piston within said cylinder correspondingly advances said piston plunger within said cartridge barrel to dispense the flowable component through the nozzle, and retraction displacement of said power piston within said cylinder correspondingly retracts said piston plunger from said cartridge barrel.

2. A dispenser gun for dispensing a flowable component composition from a cartridge having at least one barrel charged with a flowable component and a nozzle for passage of the flowable component from the barrel for dispensing, said dispensing gun comprising:

a power piston unit including a main pressure cylinder and a power piston reciprocal within said cylinder along a first direction;

head means defining a fixture adapted to receive and support the cartridge;

means for displacing said power piston within said main pressure cylinder, said displacing means comprising a pressure fluid source, and valve means for selectively connecting said pressure fluid source to one end of said cylinder for advancing displacement of said power piston, and to the opposite end of said cylinder for retraction displacement of said power piston, said valve means further including means for depressurizing the one end of the cylinder to cease advancing movement of said power piston;

a piston plunger adapted for reception into the cartridge barrel to dispense the flowable component through the nozzle;

a piston rod coupled at one end to said power piston and at an opposite end to said piston plunger, such that advancing displacement of said power piston within said cylinder correspondingly advances said piston plunger within said cartridge barrel to dispense the flowable component through the nozzle, and retraction displacement of said power piston within said cylinder correspondingly retracts said piston plunger from said cartridge barrel; and means responsive to depressurization of the one end of the cylinder for at least slightly retracting the power piston upon cessation of advancing displacement of said power piston within said cartridge, said depressurization responsive means comprising a piston sleeve movably mounted within said power piston for reciprocation generally along said first direction and having a pressure chamber formed therein for connection to said pressure source upon advancing displacement of said power piston, a stop formed on said power piston, said piston sleeve being displaced away from said stop during advancing displacement of said power piston, and means for bleeding the pressure from said pressure chamber through an orifice at one end of said piston sleeve upon depressurization of said one end of the cylinder to apply the accumulated pressure against the piston sleeve and force the piston sleeve to impact the stop for at least slightly retracting the power piston within the cylinder.

3. The disperser gun of claim 2 wherein said valve means further includes means for depressuring the opposite end of said cylinder during advancing displacement of said power piston, and for depressurizing the one end of said cylinder during retraction displacement of the power piston.

4. A dispenser gun for dispensing a multicomponent composition from a cartridge having multiple barrels charged with flowable components and a mixing nozzle for passage of the flowable components from the barrels for mixing and dispensing, said dispensing gun comprising:

a power piston unit including a main pressure cylinder and a power piston reciprocal within said cylinder along a first direction;

head means defining a fixture adapted to receive and support the cartridge with the cartridge barrels oriented to extend generally along a second direction;

means for displacing said power piston within said main pressure cylinder;

a plurality of piston plungers adapted for reception respectively into the cartridge barrels to dispense the flowable components through the mixing nozzle; and a plurality of flexible coiled spring piston rods coupled at one end to said power piston and at their opposite ends respectively to said piston plungers, said piston rods extending from said power piston through curved guide passages formed in said head means to said piston plungers, such that advancing displacement of said power piston within said cylinder correspondingly advances said piston plungers within said cartridge barrels to dispense the flowable components through the mixing nozzle, and retraction displacement of said power piston within said cylinder correspondingly retracts said piston plungers from said cartridge barrels.

5. The dispenser gun of claim 4 wherein said displacing means comprises a pressure fluid source, and valve means for selectively connecting said pressure fluid source to one end of said cylinder for advancing displacement of said power piston, and to the opposite end of said cylinder for retraction displacement of said power piston.

6. The dispenser gun of claim 5 wherein said valve means further includes means for depressuring the opposite end of said cylinder during advancing displacement of said power piston, and for depressurizing the one end of said cylinder during retraction displacement of the power piston.

7. The dispenser gun of claim 5 wherein said valve means includes means for depressurizing the one end of the cylinder to conclude composition dispensing.

8. The dispenser gun of claim 7 further including pressure responsive means for at least slightly retracting the power piston upon depressurization of the one end of the cylinder.

9. The dispenser gun of claim 8 wherein said pressure responsive means comprises a piston sleeve movably mounted within said power piston for reciprocation generally along said first direction and having a pressure chamber formed therein for connection to said pressure source upon advancing displacement of said power piston, a stop formed on said power piston, said piston sleeve being displaced away from said stop during advancing displacement of said power piston, sand means for bleeding the pressure from said pressure chamber through an orifice at one end of said piston sleeve upon depressurization of said one end of the cylinder to apply the accumulated pressure against the piston sleeve and force the piston sleeve to impact the stop for at least slightly retracting the power piston within the cylinder.

10. A dispenser gun for dispensing a dual component composition from a cartridge having twin barrels charged with flowable components and a mixing nozzle for passage of the flowable components from the barrels for mixing and dispensing, said dispensing gun comprising:

a power piston unit including a main pressure cylinder and a power piston reciprocal within said cylinder along a first direction;

head means defining a fixture adapted to receive and support the cartridge with the cartridge barrels oriented to extend generally along a second direction;

means for displacing said power piston within said main pressure cylinder;

a pair of piston plungers adapted for reception respectively into the cartridge barrels to dispense the flowable components through the mixing nozzle; and a pair of flexible coiled spring piston rods coupled at one end to said power piston and at their opposite ends respectively to said piston plungers, said piston rods extending from said power piston through curved guide passages formed in said head means to said piston plungers, such that advancing displacement of said power piston within said cylinder correspondingly advances said piston plungers within said cartridge barrels to dispense the flowable components through the mixing nozzle, and retraction displacement of said power piston within said cylinder correspondingly retracts said piston plungers from said cartridge barrels.

11. The dispenser gun of claim 10 wherein said first and second directions are generally parallel to each other.

12. The dispenser gun of claim 11 wherein said curved guide passages formed in said head means turns said piston rods smoothly through an angle of about 180°.

13. The dispenser gun of claim 10 wherein said main pressure cylinder is oriented to define front and rear ends, with said power piston moving toward said rear end during advancing displacement, and wherein said fixture supports said cartridge over said power piston unit with the mixing nozzle extending generally in parallel with and in a forward direction relative to said main pressure cylinder.

14. The dispenser gun of claim 13 further including a handgrip mounted beneath said power piston unit.

15. The dispenser gun of claim 10 wherein said displacing means includes means for advancing and retracting said power piston within said main pressure cylinder.

16. The dispenser gun of claim 15 wherein said displacing means comprises a pressure fluid source, and valve means for selectively connecting said pressure fluid source to one end of said cylinder for advancing displacement of said power piston, and to the opposite end of said cylinder for retraction displacement of said power piston.

17. The dispenser gun of claim 16 wherein said valve means further includes means for depressuring the opposite end of said cylinder during advancing displacement of said power piston, and for depressurizing the one end of said cylinder during retraction displacement of the power piston.

18. The dispenser gun of claim 16 wherein said valve means includes means for depressuring the one end of the cylinder to conclude composition dispensing.

19. The dispenser gun of claim 18 further including pressure responsive means for at least slightly retracting the power piston upon depressurization of the one end of the cylinder.

20. The dispenser gun of claim 19 wherein said pressure responsive means comprises a piston sleeve movably mounted within said power piston for reciprocation generally along said first direction and having a pressure chamber formed therein for connection to said pressure source upon advancing displacement of said power piston, a stop formed on said power piston, said piston sleeve being displaced away from said stop during advancing displacement of said power piston, and means for bleeding the pressure from said pressure chamber through an orifice at one end of said piston sleeve upon depressurization of said one end of the cylinder to apply the accumulated pressure against the piston sleeve and force the piston sleeve to impact the stop for at least slightly retracting the power piston within the cylinder.

* * * * *